United States Patent [19]

Loof et al.

[11] 4,378,648

[45] Apr. 5, 1983

[54] MARKING DEVICE FOR ELECTRICAL WIRES

[75] Inventors: Göran Loof, Gullspång; Lars Skarin, Otterbäcken, both of Sweden

[73] Assignee: Partex Fabriksaktiebolag, Gullspång, Sweden

[21] Appl. No.: 300,545

[22] Filed: Sep. 9, 1981

[30] Foreign Application Priority Data

Sep. 10, 1980 [SE] Sweden ..... 8006337

[51] Int. Cl.[3] ..... G09F 3/00

[52] U.S. Cl. ..... 40/316

[58] Field of Search ..... 40/316, 21 R, 21 C, 40/23, 316

[56] References Cited

U.S. PATENT DOCUMENTS

| | | | |
|---|---|---|---|
| 2,491,472 | 1/1970 | Walldorf | 40/316 |
| 3,212,207 | 10/1965 | Searing | 40/316 |
| 3,310,623 | 3/1967 | Vaughn | 24/17 B |
| 4,234,090 | 11/1980 | Barbieri et al. | 40/316 |

FOREIGN PATENT DOCUMENTS

| | | | |
|---|---|---|---|
| 13152 | 12/1979 | European Pat. Off. | 40/316 |
| 980516 | 5/1951 | France | 40/316 |
| 1254256 | 5/1961 | France | 40/316 |
| 2254256 | 12/1973 | France | 40/316 |
| 474129 | 7/1969 | Switzerland | 40/316 |
| 364539 | 11/1969 | Switzerland | 40/316 |

*Primary Examiner*—Gene Mancene
*Assistant Examiner*—Wenceslao J. Contreras
*Attorney, Agent, or Firm*—Pollock, Vande Sande & Priddy

[57] ABSTRACT

The invention relates to marking sleeves for electrical wires. It solves the problem of providing a sleeve which combines ease of manufacturing with possibility to use the sleeve on wires within a wide diameter range so that the sleeve is securely held in position also when carried by a thin wire. The sleeve is of the type made of a resilient synthetic resin and, according to the invention, its outer contour is substantially rectangular, whereas its inner contour, defining the passage, forms part-circular recesses for receiving wires within the lower portion of the diameter range.

3 Claims, 3 Drawing Figures

MARKING DEVICE FOR ELECTRICAL WIRES

Figure 1A:
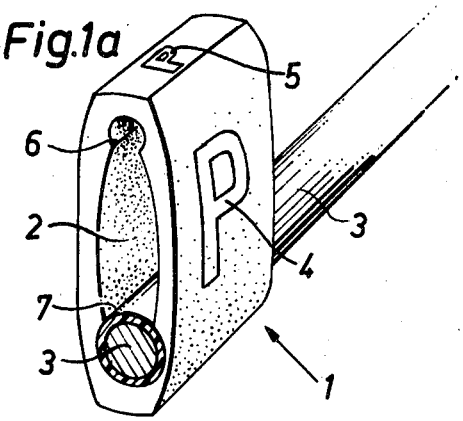

The present invention relates to a device for marking electrical wires and the like. It consists of a body which is generally extruded from an elastic, synthetic resin material and has a through passage for the wire. The wall of the body defining said passage is closed in the circumferential direction. Thanks to the elasticity of the material the device may be mounted on wires the outer diameter of which varies within a given range.

In prior art marking devices which are closed in the circumferential direction, i.e. sleeve-shaped or tubular, so that mounting on a wire requires that a free wire end is inserted through the sleeve, the potential for using the device for wires within a diameter range has generally been attained by providing part of the sleeve wall with an expansion portion comprising one or more bellows-shaped folds or the like. Swiss patent No. 607 245 shows a marking sleeve of that type. That design principle may be replaced or supplemented by the use of inwardly directed thin tongues or ribs resiliently contacting the wire as disclosed in e.g. Swiss patent No. 594 270.

Marking devices designed according to the above-mentioned principles have several inherent limitations and drawbacks. First, the diameter range within which each given sleeve can be used is comparatively limited. Second, in many applications there is a risk that, when the sleeve is mounted on a wire the diameter of which is close to the lowest value of the range, it may unintentionally be deformed and assume a position in which its marking symbols can no longer be observed. Even when such a rotation or displacement of the sleeve does not occur there is a definite drawback that, due to its geometry, it has one marking portion and one expansion portion or, more directly put, marking symbols can be applied on just a relatively small portion of the sleeve wall. As is understood, marking symbols cannot be carried by the folded parts of the sleeve wall. However, it is often desirable to have the potential for providing marking symbols in more places than one, so that they can be observed even when the sleeve is moved from its mounting position. A fourth disadvantage is that, since extrusion constitutes the only economical manufacturing method, the presence of folds, bellows-like parts, thin ribs or tongues result in a complicated profile requiring a high precision in the manufacturing process, especially in the form of narrow tolerances as far as material quality, extrusion temperature, cooling, etc. are concerned.

The object of the invention is to provide a marking device which, especially in the respects above mentioned, is superior to the prior art devices of the same general types. Accordingly, it shall be usable within a wide diameter range and it shall be possible to mount it also on thin wires without the aid of folds, thin tongues, ribs or the like. Also, it shall be possible to provide it with marking symbols around all of its circumference and its profile shall be uncomplicated in the sense that no severe tolerances are imposed on the extrusion process. The main characteristic of the invention is that the external contour of the body forming the marking device is substantially rectangular whereas its internal contour, defining the passage, is composed by a number of arcs of circles of mutually different diameters. The body is symmetrical relative to a plane including the longitudinal axis of the through passage so that the latter will be defined by pair-wise oppositely located arcs.

Two embodiments of the invention will now be described with reference to the drawing.

FIG. 1*a* is a perspective view showing a marking sleeve according to the first embodiment mounted on a relatively thin wire.

Figure 1B:
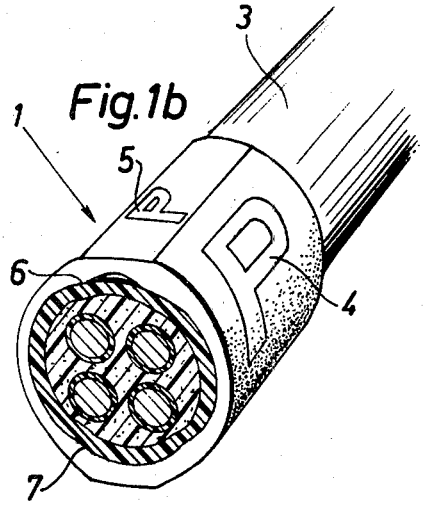

FIG. 1*b* is a perspective view showing the sleeve of FIG. 1*a* mounted on a wire of maximum diameter.

Figure 2:
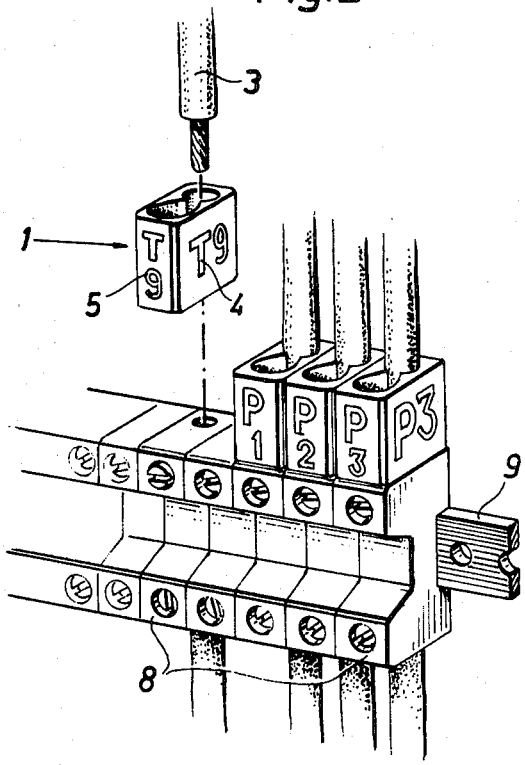

FIG. 2 is a perspective view showing a number of marking sleeves mounted on wires connected to terminal blocks.

The marking device shown in FIG. 1*a* or 1*b* consists of a body 1 of a resilient synthetic resin material. It has a through passage 2 which is closed in its circumferential direction and is intended to receive a wire 3 to be marked for identification purposes. As appears from FIG. 1*a*, the wall thickness of the tubular body, or sleeve, 1 is slightly non-uniform. The thickest portions form two projections 6 and 7, which divide the passage into three cavities; an upper cavity having substantially circular cross-section, a lower cavity, also of substantially circular cross-section but of greater diameter than the upper cavity, and a central space of substantially elliptical cross-section. Those three spaces communicate via slots between projections 6 and 7. The outer walls of the device are constituted by two slightly curved side-walls and by a bottom wall and a top wall which both are substantially planar. Numerals 4 and 5 designate marking symbols, located on one of the side walls and on the top wall, respectively.

In FIG. 1*b* the marking sleeve 1 has been mounted on a wire or cable 3 the circumference of which corresponds to the complete inner circumference of the sleeve when expanded to annular form.

It should be observed that a marking device as shown in FIG. 1*a* or 1*b* may be safely held into position on wires 3 the diameters of which correspond to the diameters of the upper or lower cavity of the passage. In addition thereto, it may be mounted on wires the diameters of which fall within the range between that of the upper cavity and the diameter of the multi-strand cable 3 shown in FIG. 1*b*.

In the embodiment shown in FIG. 2 marking device 1 is of substantially parallelepipedic shape and its passage consists of two communicating cavities. A number of such marking devices are carried by electrical wires 3, connected to terminal blocks 8 fastened to a rail 9. It appears from the drawing that, in spite of the fact that such a marking sleeve may, in its fully expanded form, be applied on much thicker wires it will, when mounted on a relatively thin wire 3 present a forwardly facing surface, the width of which does not exceed that of blocks 8. The surface available for marking symbols is optimized and the marking sleeves are securely held in their mounted positions. The embodiments of the sleeve shown in FIGS. 1*a* and 2 both include two inter-communicating part-circular recesses, each of which extends more than 180°.

The two embodiments of the invention above described and shown on the drawing have been selected for illustration purposes only. The invention comprises many other embodiments and modifications, especially as far as the profile of the sleeves is concerned. In some applications the sleeves may have grooves or slots not intended to receive any wires but only to facilitate the deformation of the sleeve when it is to be mounted on thick wires. The inventive idea is the realization that a marking sleeve may be designed so as to cover a broad diameter range without having to be provided with thin folds or tongues which complicate the manufacturing process without offering an acceptable protection against unintentional displacement of the sleeve when mounted on wires the diameters of which fall within the lower portion of that range.

We claim:

1. A device for marking electrical wires, cables and the like, comprising a body of a synthetic resin material having an inner passage for receiving the wire, the body being resiliently deformable so as to permit use thereof on wires within a given diameter range, characterized in that, in its undeformed state, the cross-section of the body, as seen in a plane perpendicular to the longitudinal axis of the passage, is such that its outer contour is substantially rectangular, whereas its inner contour forms inter-communicating part-circular recesses for receiving wires within the lower portion of said diameter range while retaining the substantially rectangular outer contour of the body, which is deformable to substantially annular form for receiving wires in the upper portion of said range.

2. The device of claim 1 which includes at least two part-circular recesses of different diamters.

3. The apparatus of claim 1 wherein each of said part-circular recesses extends more than 180°.

* * * * *